United States Patent [19]

MacGavin

[11] Patent Number: 4,643,065

[45] Date of Patent: Feb. 17, 1987

[54] SAW CHAIN COMPRISED OF SAFETY SIDE LINKS DESIGNED FOR REDUCING VIBRATION

[75] Inventor: Donald J. MacGavin, Portland, Oreg.

[73] Assignee: Omark Industries, Inc., Portland, Oreg.

[21] Appl. No.: 869,344

[22] Filed: Jun. 2, 1986

[51] Int. Cl.[4] ..... B27B 33/14

[52] U.S. Cl. ..... 83/830; 83/834

[58] Field of Search ..... 83/830, 833, 834; 125/21

[56] References Cited

U.S. PATENT DOCUMENTS

| | | | |
|---|---|---|---|
| 4,122,741 | 10/1978 | Engman | 83/834 |
| 4,590,836 | 5/1986 | Doiron | 83/834 |
| 4,593,591 | 6/1986 | Beerens | 83/834 |
| 4,604,932 | 8/1986 | Doiron | 83/830 |
| 4,608,901 | 9/1986 | Doiron | 83/834 |

*Primary Examiner*—Donald R. Schran

*Attorney, Agent, or Firm*—Robert L. Harrington

[57] ABSTRACT

A saw chain length including articulated alternating center drive links and side links. Cutting links provide certain of the side links and a safety side link precedes each cutting link. The safety side link and its opposing tie strap link have shaved heel portions and thereby are raised off the guide bar when normally tensioned around the guide bar. The safety link is configured whereby engagement thereof by material being cut during a cutting operation induces pivoting of the safety link against the opposing tension force, which tension force thereby absorbs the impact prior to said heel portions engaging the guide bar edge.

5 Claims, 2 Drawing Figures

SAW CHAIN COMPRISED OF SAFETY SIDE LINKS DESIGNED FOR REDUCING VIBRATION

FIELD OF INVENTION

Saw chain comprised of safety side links designed for reducing vibration.

BACKGROUND OF INVENTION

A chain saw's components include, a loop of saw chain consisting of interconnected links, some of which carry cutting teeth, a guide bar that guides and supports the loop of saw chain for rapid rotation around the guide bar, and a power head that drives the saw chain and also provides the handles that the sawyer grips for directing the cutting action of the chain saw. Wood is non-homogeneous and its resistance to cutting is inconsistent and therefore rough. The chain saw is necessarily a very powerful tool and one that inherently demands concern for both safe operation and cutting performance.

A primary concern of recent years is the occurrence of kickback. Kickback occurs when a cutting tooth "hooks" into a limb or log (generally while passing around the outer end or nose of the guide bar) in such a manner as to induce rearing of the chain and bar and possible injury to the sawyer. Such kickback action has been a concentrated target for design improvements and has been largely reduced by providing guard like protrusions that precede the cutting tooth.

A secondary consideration of the chain saw sawyer is the incidence of vibration. The very nature of a rotating cutting chain engaging and cutting a tree or log wherein small wood chips are rapidly ripped from the log, creates vibration. This vibration, over time, is detrimental to the sawyers health and causes what is termed in the industry as "white fingers disease". This is a numbness that appears in the sawyers hands after extended use of a chain saw.

reducing the vibration that occurs in the operation of a chain saw is the objective of Engman et al in U.S. Pat. No. 4,122,741. Engman determined that vibration was largely caused when the cutting edge engaged a hard spot in the wood, e.g., a knot. The cutting link was pivoted about its heel and because the cutting edge was forward of the heel, it pivoted deeper into the wood causing the chain to jerk or vibrate. This action was alleviated by changing the geometry of the cutting link whereby the heel was elevated off the bar so that a cutting impact caused the cutting edge to pivot around the front rivet, i.e., out of the wood.

Not disclosed or suggested in Engman is a safety link which often is added to the sequence of chain links to decrease kickback likelihood at the nose of the guide bar. On the straight reach of the bar the guard portion of the link projects toward the wood but is normally short of the cutting edge and does not cut. Its presence in the chain link sequence during a typical cutting operation nevertheless induces vibration that is not explained by the Engman theory. Furthermore, the vibration is present irrespective of the location of the guard portion over the rear rivet of the link, i.e., where rearing of the link would not increase the outward projection of the guard portion. Whereas the increased vibration is a problem for the sawyer, nevertheless the safety link is necessary for solving a problem of higher priority, i.e. reducing the likelihood of kickback. Therefore the sawyer has heretofore simply lived with the vibration caused by the safety links.

BRIEF SUMMARY OF THE INVENTION

The present invention is based on a re-evaluation of the cutting chain, not simply in consideration of how a cutting link functions to cut wood chips, but how the combination of the safety links and cutting links (in a safety design cutting chain) act in concert to generate vibration. In such evaluation, it was concluded that the presence of the guard portion or protrusion preceding the depth gauge and cutting edge of a cutting link, engages and absorbs impact by its proximate location in the kerf, i.e., it engages irregularities or chips present in the kerf.

In Engman, the jerking vibration is thought to be induced by the cutting edge of a cutting link digging in deeper as the link is pivoted. This jerking action is conveyed through the chain links and felt by the sawyer as a form of vibration. It is avoided by changing the geometry of the link to cause the cutting edge to pivot away from, rather than into, the kerf.

The invention herein deduces, in contradistinction to Engman, that the safety link induced vibration is caused by the rapid, brief, non-cutting engagement of the protruding guard portion with an irregularity or chips in the kerf. This causes the safety link to snap back and in effect hammers the guide bar.

The present invention is directed to alleviating the vibration contributed by the hammering action of the safety link by designing the safety link in combination with the chain link sequence so as to be raised off the guide bar in the area of the guard portion (preferably at the rear of the link), whereby the tension of the chain in operation acts as a shock absorber. The snapping back action described is simply absorbed by the chain tension and not by the guide bar. Vibration in a safety link chain has been found to be significantly reduced using this design concept.

DETAILED DESCRIPTION AND DRAWINGS

Figure 1:
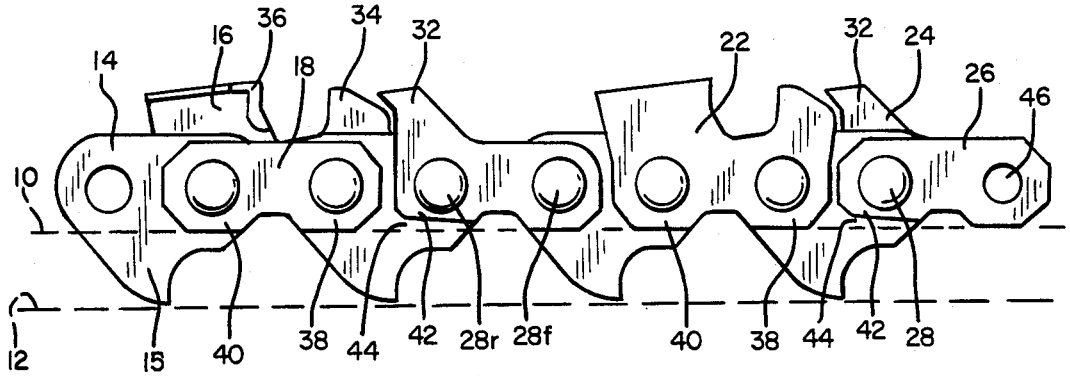
Figure 2:
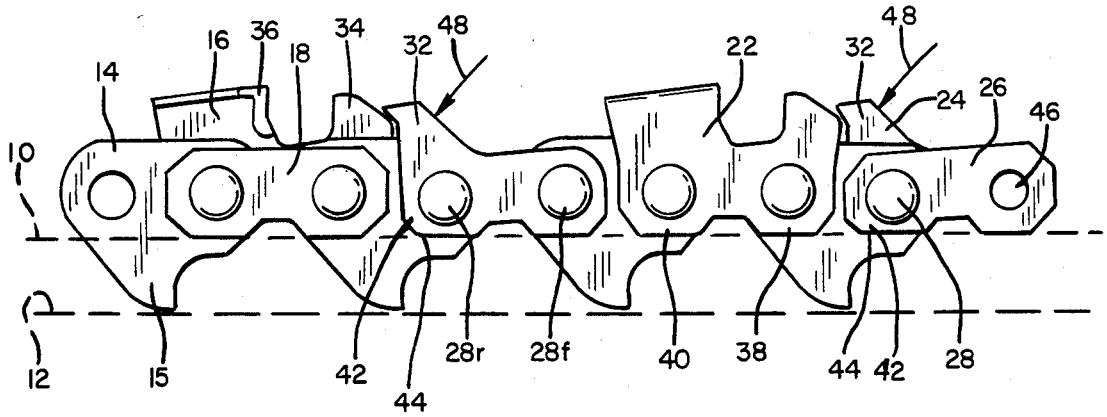

The invention will be more clearly understood and appreciated by reference to the following detailed description having reference to the accompanying drawings wherein:

FIG. 1 illustrates a length of cutting chain of the present invention as supported on a guide bar in free running condition; and FIG. 2 illustrates the cutting chain of FIG. 1 and particularly the bumper link, in reaction to engagement with a log or tree in a cutting action.

In the drawings, dash line 10 represents the peripheral edge of a guide bar in which a groove is formed. The bottom of the groove is represented by dash line 12. As illustrated, a length of saw chain in accordance with the present invention includes center drive links 14 having drive tangs 15 that ride in the groove (12) of the guide bar. These drive tangs (in addition to being engaged by the teeth of the drive sprocket when rotated around the rear end of the guide bar) entrain the chain on the grooved bar edge.

Interconnecting the center drive links are side links that, in general, ride on the bar edge (10). These side links include, in sequence back to front, a first pair of side links consisting of a left hand cutting link 16 (having a cutting edge 36 preceded by a depth guage 34) and a tie strap 18 opposite thereto; a second pair of side links consisting of a right hand safety or bumper link 20 (with guard portion 32) and a tie strap (hidden) opposite thereto; a third pair of side links consisting of a right hand cutting link 22 (also with a cutting edge and depth gauge) and a tie strap (hidden) opposite thereto; and a fourth pair of side links consisting of a left hand safety link 24 (with guard portion 32) and a tie strap 26 opposite thereto. The pairs of side links are pivotally connected to the drive links 14 by rivets 28. Furthermore, the links just described represent a full sequence of the links in the saw chain and that sequence is repeated with a drive link 14 preceeding side links 24, 26 which in turn is preceeded by side links 16, 18 etc.

The general relationship just described of the safety link protrusion, depth gauge and cutting edge is not new with the present invention. However, prior safety links have taken many forms with a commonality being that the guard portion projects outwardly or upwardly (from the bar as depicted), to the approximate height of the depth gauge 34 with a leading front edge that is configured so as to avoid hooking, e.g., it is slanted upwardly and rearwardly.

In the present invention it is desirable that the guard portion 32 project rearwardly and upwardly over the vicinity of its rear rivet 28*r* (as distinguished from front rivet 28*f*). A general specification for the guard portion is that the outermost projection of the guard portion 32 (outermost being upwardly as viewed in the drawings) be located rearward of a vertical line centered between the front and rear rivets. It is also desirable that the right safety link 20 precede the left cutting link 16 so that interference does not occur therebetween. The desirability of this configuration for the safety links 20 and 24 is for the purpose of accomodating shock absorption pivoting of the safety links as will now be explained.

It will be observed from FIG. 1 that the tie strap 18, opposite cutting link 16, and cutting link 22, have front and rear bar engaging portions, 38, 40 (sometimes referred to as the toe and heel portions of the link) that ride, in a non-cutting mode, directly on the edge 10 of the guide bar. Although not shown, it will be understood that cutting link 16 and the tie strap opposite cutting link 22, similarily have toe and heel portions 38, 40. This represents every other pair of side links. The intermediate side links (safety link 20 and opposing tie strap, hidden), and safety link 24 and opposing tie strap 26 are provided with toe portions 38 but the heel portions 42 are raised off the bar edge in the non cutting mode, i.e., creating a gap 44.

Whereas gap 44 can vary, it has been found that for a $\frac{3}{8}$ inch pitch chain, wrapped around a guide bar and tensioned in accordance with chain saw manufacturer's instructions, this gap is in the range of about 0.010 inch to 0.025 inch and preferably about 0.020 inch, i.e. heel 42 is 0.020 inch shorter than heels 38 and 40 (the distance below the rivet or more precisely, the distance below the rivet hole openings). A rivet hole opening 46 is illustrated for side link 26 and represents the rivet holes provided in the side links for all of the rivets 28 (28*r* and 28*f*).

FIG. 2 illustrates the reaction of the safety link when it engages material to be cut. Arrows 48 indicate the force applied against protrusion 32. The result is that the link pairs 20, (and the opposite tie strap) and 24, 26, rather than transmitting the force 48 as a jarring impact against the bar edge (10), rotate around the pivot point under the front rivet 28*f*, as permitted by the spacing between heel 42 and bar edge 10, i.e., gap 44. Gap 44 is essentially closed (depending on the angle and degree of force 48) but because of the chain tension, this pivoting of the links is strongly resisted, e.g. in a manner similar to a strong spring holding the link away from the bar. The force 48 is thus largely absorbed by the resisted pivoting of the links and to a substantial degree, vibration is alleviated.

Whereas variations are possible, the invention is considered to be encompassed by the appended claims and not limited to the specific embodiment herein described and depicted.

I claim:

1. A saw chain formed into a continuous loop and designed to be entrained on the edge of a guide bar of a chain saw comprising; alternating center links and pairs of side links pivotally interconnected by front and rear rivets, certain pairs of said side links including a cutting link and opposed tie strap link, and a preceding pair of side links including a safety link and opposed tie strap link, said preceding pair of side links each having a toe portion and a heel portion positioned under the front and rear rivets, respectively, and each of said toe and heel portions having bar engaging surfaces, said bar engaging surface of the heel portion spaced below the rear rivet a distance less than the distance of the bar engaging surface of the toe portion below the front rivet, whereby the tension applied to the saw chain about the guide bar that normally maintains the rivets in alignment, raises the heel portions of said preceding pairs of side links off the guide bar edge.

2. A saw chain as defined in claim 1 wherein the differential in the spacing of the bar engaging surfaces of the toe and heel portions is between 0.010 and 0.025 inch.

3. A saw chain as defined in claim 2 wherein the safety link includes an upwardly projected guard portion, the outermost point of said guard portion being rearward of a vertical line centered between the front and rear rivets.

4. A saw chain as defined in claim 3 wherein the guard portion is projected upwardly and rearwardly at a position substantially over the rear rivet.

5. A saw chain as defined in claim 4 wherein the bar engaging surface of the heel portion of said preceding pair of side links is normally raised over the guide bar edge a distance of about 0.020 inch.

* * * * *